US006521059B1

(12) United States Patent
Nazmy et al.

(10) Patent No.: US 6,521,059 B1
(45) Date of Patent: Feb. 18, 2003

(54) BLADE AND METHOD FOR PRODUCING THE BLADE

(75) Inventors: Mohamed Nazmy, Fislisbach (CH); Markus Staubli, Dottikon (CH)

(73) Assignee: Alstom, Paris (FR)

( * ) Notice: Subject to any disclaimer, the term of this patent is extended or adjusted under 35 U.S.C. 154(b) by 0 days.

(21) Appl. No.: 09/213,428

(22) Filed: Dec. 17, 1998

(30) Foreign Application Priority Data

Dec. 18, 1997 (DE) ..... 197 56 354

(51) Int. Cl.[7] ..... C22C 14/00
(52) U.S. Cl. ..... 148/421; 148/669
(58) Field of Search ..... 148/415, 523, 148/552, 549, 688, 669, 421, 437; 29/90.7, 889.7

(56) References Cited

U.S. PATENT DOCUMENTS 4,799,974 A * 1/1989 Mahoney et al.
4,883,545 A * 11/1989 Matlock et al. ..... 148/500
4,909,859 A * 3/1990 Nazmy et al. ..... 148/518
4,969,593 A * 11/1990 Kennedy et al.
5,299,353 A * 4/1994 Nazmy et al.
5,415,831 A * 5/1995 Baumann et al. ..... 419/49
5,549,768 A * 8/1996 Mahoney

FOREIGN PATENT DOCUMENTS

| | | | |
|---|---|---|---|
| AT | 001669 | U1 | 9/1997 |
| DE | 4219469 | A1 | 12/1993 |
| DE | 4219470 | A1 | 12/1993 |
| DE | 4304481 | A1 | 8/1994 |
| DE | 4121228 | C2 | 10/1994 |
| DE | 44 35 321 | A1 | 4/1996 |
| EP | 0455005 | A1 | 11/1991 |
| EP | 0513407 | A1 | 11/1992 |
| JP | 4-41682 | A | 2/1992 |

* cited by examiner

*Primary Examiner*—Roy King
*Assistant Examiner*—Harry D. Wilkins, III
(74) *Attorney, Agent, or Firm*—Burns, Doane, Swecker & Mathis, L.L.P.

(57) ABSTRACT

In a blade possessing a blade body and a blade foot consisting of an alloy based on a doped gamma-titanium aluminide, at least part of the surface layer of the blade has a finely-grained structure, and the core has a coarsely-grained structure. The ductility of the finely-grained surface layer is higher than that of the coarsely-grained core. In a method for producing the blade, the surface is deformed after casting and hot-isostatic pressing of the blade. The deformed surface layer undergoes recrystallization annealing.

11 Claims, 1 Drawing Sheet

BLADE AND METHOD FOR PRODUCING THE BLADE

FIELD OF THE INVENTION

The invention relates to blades is based on a blade made from an alloy based on a doped gamma-titanium aluminide and methods for making blades.

BACKGROUND OF THE INVENTION

EP 0 513 407 B1 describes a blade of an alloy based on doped gamma-titanium aluminide in which the blade foot has a finely-grained structure, and the blade body has a coarsely-grained structure. Because of this, the blade body supposedly has a good creep strength and tensile strength resistance at high temperatures, the blade foot a high ductility. The problem, however, is the fatigue behavior of the blade body that is due to its coarsely-grained structure and the relatively complex blade production.

SUMMARY OF THE INVENTION

The invention is based on the task of improving the fatigue behavior and the creep strength resistance in a blade and a method for producing the blade of the initially mentioned type.

According to the invention, this is accomplished by providing a blade comprising a blade body and a blade foot made from an alloy based on doped gamma-titanium aluminide, at least part of the surface layer of the blade having a finely-grained structure, and the core has a coarsely-grained structure, whereby the ductility of the finely-grained surface layer is higher than that of the coarsely-grained core.

According to a further aspect of the invention, a method for producing the blade includes a method for producing a blade, wherein the method comprises casting and hot-isostatic pressing of the blade, and deforming the surface of the blade, wherein the deformed surface layer is subjected to recrystallization annealing.

An important aspect of the invention is therefore that at least part of the surface structure of the blade has a finely-grained structure, and the core has a coarsely-grained structure, whereby the ductility of the finely-grained surface layers is higher than that of the coarsely-grained core.

The advantages of the invention are, among others, that, the combination of coarsely-grained structure in the core and finely-grained structure on the surface of the blade increases the surface ductility and improves the fatigue behavior as well as tensile and creep strength resistance compared to previously known blades. Since the grain-size in gamma-titanium aluminides represents the critical value for fissure growth, the reduction of the grain size on the surface increases the error tolerance and thus improves the useful life of the blade. The thermomechanical fatigue resistance is also improved by the finely-grained surface layer.

It is particularly advantageous to provide only the blade body with a finely-grained surface layer since it is particularly susceptible to thermomechanical fatigue stresses. This makes it possible to increase the useful life of the blade body.

BRIEF DESCRIPTION OF THE DRAWING FIGURES

The drawing figures show a schematic exemplary embodiment of the invention in the form of a blade, wherein.

DETAILED DESCRIPTION OF THE INVENTION

This application corresponds to and claims priority under 35 U.S.C. §119 with respect to German Application No. 197 56 354.6 filed on Dec. 18, 1997,the entire-content of which is incorporated herein by reference.

Figure 1:
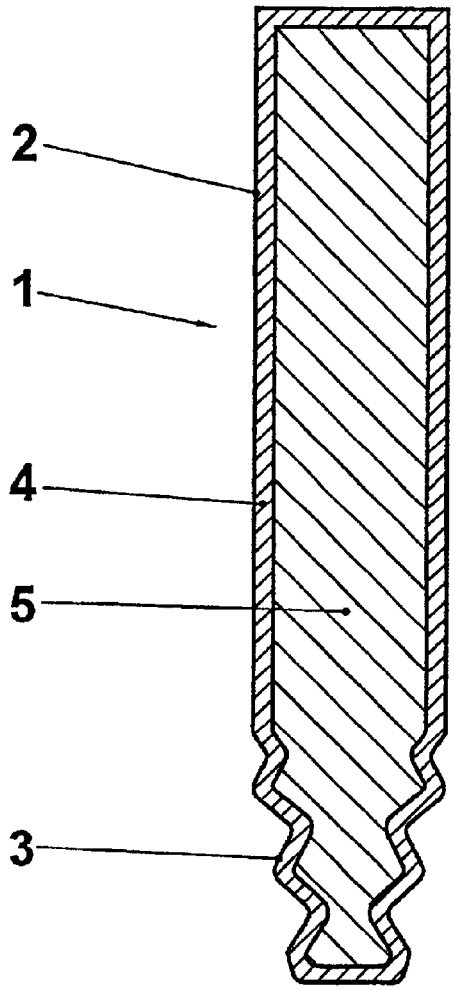
FIG. 1 shows a longitudinal section through a blade according to the invention.
Figure 2:
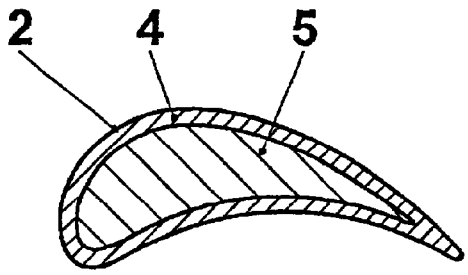
FIG. 2 shows a cross-section through a blade according to the invention. Only those elements essential for understanding the invention are shown.

FIGS. 1 and 2 show a blade 1 produced according to the invention and having a blade body 2 and blade foot 3. A finely-grained zone 4 on the surface of the blade 1 surrounds a coarsely-grained zone 5 in the core of the blade whose structure is determined essentially by the production process of the blade.

Finely-grained means that the grain size ranges approximately from 10 to 100 $\mu$m or less, coarsely-grained means that the grain size ranges approximately from 200 to 600 $\mu$m.

The cast body shown in the figures consists essentially of an alloy based on a doped gamma-titanium aluminide, as it is known, e.g., from EP 0 455 005 A1. The coarsely-grained structure 5 results in a structure with a high tensile and creep strength resistance. The finely-grained structure 4 has a higher ductility, higher error tolerance, and better fatigue behavior than the coarsely-grained structure 5. This results in a long useful life of the blade.

The turbine blade according to the invention can be used advantageously at medium and high temperatures, i.e., at temperatures between 200 and 1,000° C., in particularly in gas turbines and compressors. Depending on the embodiment of the gas turbine or compressor, an additional blade cover plate (not shown here) can be present.

The blade 1 according to the figures is produced as follows: Under inert gas, such as e.g., argon, or under a vacuum, the following alloy based on a gamma-titanium aluminide doped with chromium is melted in an induction furnace:

| | |
|---|---|
| Al = 48 | At.-% |
| Cr = 3 | At.-% |
| Ti = Rest. | |

Other suitable alloys are gamma-titanium aluminides as described in EP 0 455 005 A1, which are doped with at least one or more of the following elements: B, Co, Cr, Ge, Hf, Mn, Mo, Nb, Pd, Si, Ta, V, Y, W and Zr. The amount of doping material that is added is preferably 0.5 to 8 at. %.

The molten mass is poured into a casting mold corresponding to the turbine blade to be produced, Casting skin and scale layer are then removed from the casting body by removing, e.g., a surface layer of about 1 mm thickness either mechanically or chemically. The descaled cast body is pushed into a suitable capsule made from soft carbon steel, and the latter is welded in a gas-tight manner. The encapsulated cast body is now hot-isostatically pressed (HIP) at a temperature of 1,260° C. for three hours under a pressure of about 172 MPa and cooled.

Depending on the composition of the alloy, the hot-isostatic pressing should be performed advantageously for at least one and no more than five hours at temperatures between 1,200 and 1,300° C. and a pressure between 150 and 190 MPa.

In order to increase the ductility of the hot-isostatically pressed blade, the formed cast body can be annealed between 1,270° C. and 1,330, in particular, 1,300° C. for, e.g., 1 to 10 hours under an argon atmosphere, and is then cooled to room temperature.

The hot-isostatically pressed blades are then shot-peened. The pressure hereby can be 2 to 4 bar; the shot-peening material can consist of glass spheres with a diameter of about 1 mm, and the shot-peening time can be several minutes, in particular 2 to 3 minutes. The degree of deformation at room temperature is at least 1%.

The parameters of the shot-peening and of the thermal treatment described below make it possible to adjust the thickness and grain size of the finely-grained layer 4. A preferred layer thickness is 0.1 to 0.5 mm.

The thermal treatment following the shot-peening is a recrystallization annealing of the surface layer that was deformed by the shot-peening. This recrystallization annealing takes place from 0.5 to 10 hours between 1,000° C. and 1,400° C. After this, the blades were cooled in the furnace to room temperature RT by adding argon gas.

By holding of the blades at a certain temperature for a longer period, the size of the surface layer grains can be adjusted, i.e., a longer holding of the blades will increase the size of the grains in the surface layer.

The following table contains particularly preferred thermal treatments.

| Treatment | A | B | C | D |
|---|---|---|---|---|
| Casting and hot-isostatic pressing | X | X | X | X |
| 1 h at 1,300° C. | X | | | |
| 10 h at 1,300° C. | | | X | |
| Shot-peening | X | X | X | X |
| 0.5 h at 1,400° C. | | | | X |
| 3 h at 1,100° C. | | X | | |
| 6 h at 1,100° C. | X | | X | X |
| Cooling in furnace with argon gas to RT | X | X | X | X |

Blades A to D produced according to the above table exhibited a finely-grained, ductile surface layer with a layer thickness between 0.1 to 0.5 mm.

The invention is naturally not restricted to the shown and described exemplary embodiment. Any other deformation processes instead of shot-peening can be used to deform the surface. Naturally, it is also possible to provide only the blade body with a finely-grained surface layer.

While the present invention has been described by reference to the above-described embodiments, certain modifications and variations will be evident to those of ordinary skill in the art. Therefore the present invention is limited only by the scope and spirit of the appended claims.

What is claimed is:

1. Blade comprising a blade body and a blade foot made from an alloy based on doped gamma-titanium aluminide, at least part of the surface layer of the blade having a finely-grained structure, and the core has a coarsely-grained structure, whereby the ductility of the finely-grained surface layer is higher than that of the coarsely-grained core.

2. Blade as claimed in claim 1, wherein the surface layer of the blade body has a finely-grained structure.

3. Blade as claimed in claim 1, wherein the surface layer has a thickness of 0.1 to 0.5 mm.

4. Method for producing the blade as claimed in claim 1, wherein the method comprises casting and hot-isostatic pressing of the blade, and deforming the surface of the blade wherein the deformed surface layer is subjected to recrystallization annealing.

5. Method as claimed in claim 4, wherein the blade is subjected to a thermal treatment prior to deformation in order to increase the ductility of the blade.

6. Method as claimed in claim 4, wherein the recrystallization annealing takes place between 1,000° C. and 1,400° C. for 0.5 to 10 hours.

7. Method as claimed in claim 5, wherein the thermal treatment takes place prior to the deformation of the surface between 1,270° C. and 1,330° C. for 1 to 10 hours.

8. Method as claimed in claim 4, wherein the surface is deformed by shot-peening.

9. A blade comprising a blade body and a blade foot made from a cast alloy based on doped gamma-titanium aluminide, at least part of the surface layer of the blade having a finely-grained structure, and the core has a coarsely-grained structure, whereby the ductility of the finely-grained surface layer is higher than that of the coarsely-grained core.

10. A blade comprising a blade body and a blade foot made from an intermetallic cast and hot isostatically pressed alloy, at least part of the surface layer of the blade having a finely-grained structure, and the core has a coarsely-grained structure, whereby the ductility of the finely-grained surface layer is higher than that of the coarsely-grained core.

11. The blade as claimed in claim 10, wherein the alloy is based on doped gamma-titanium aluminide.

* * * * *